US012797705B2

(12) United States Patent
Bohman et al.

(10) Patent No.: US 12,797,705 B2
(45) Date of Patent: Nov. 17, 2026

(54) INTERACTIVE GAME COMPRISING RAMP AND SERIES OF TARGETS

(71) Applicants: Jason Bohman, Shallotte, NC (US); Haley Bohman, Shallotte, NC (US); Autumn Sullivan, Ocean Isle Beach, NC (US); Robert Sullivan, Ocean Isle Beach, NC (US)

(72) Inventors: Jason Bohman, Shallotte, NC (US); Haley Bohman, Shallotte, NC (US); Autumn Sullivan, Ocean Isle Beach, NC (US); Robert Sullivan, Ocean Isle Beach, NC (US)

( * ) Notice: Subject to any disclaimer, the term of this patent is extended or adjusted under 35 U.S.C. 154(b) by 438 days.

(21) Appl. No.: 18/387,329

(22) Filed: Nov. 6, 2023

(65) Prior Publication Data

US 2024/0149125 A1 May 9, 2024

Related U.S. Application Data

(60) Provisional application No. 63/423,082, filed on Nov. 7, 2022.

(51) Int. Cl.
*A63B 67/06* (2006.01)
*A63B 71/00* (2006.01)

(52) U.S. Cl.
CPC ..... *A63B 67/06* (2013.01); *A63B 71/0036* (2013.01)

(58) Field of Classification Search
CPC . A63B 67/06; A63B 71/0036; A63B 2210/50; A63B 67/002
USPC ..... 273/352
See application file for complete search history.

(56) References Cited

U.S. PATENT DOCUMENTS

| | | | | |
|---|---|---|---|---|
| 5,529,304 | A * | 6/1996 | Wood | A63B 67/02 473/163 |
| 8,376,871 | B1 * | 2/2013 | Cloud | A63B 67/02 473/163 |
| 10,549,162 | B2 * | 2/2020 | Dyor | A63B 57/40 |
| 11,065,519 | B1 * | 7/2021 | Bahash | A63B 57/40 |
| 2003/0116917 | A1 * | 6/2003 | Thiemann | F41J 5/24 273/378 |
| 2020/0215423 | A1 * | 7/2020 | Hauck | A63F 1/04 |
| 2021/0252362 | A1 * | 8/2021 | Allen | A63B 67/066 |

* cited by examiner

*Primary Examiner* — Yingchuan Zhang
(74) *Attorney, Agent, or Firm* — Ashley D. Johnson; Dogwood Patent and Trademark Law

(57) ABSTRACT

A portable outdoor game that may include a ramp, a target, and one or more projectiles. The ramp may include an elongated runner and an elevation structure. The elevation structure may be positioned at one end of the runner and lift that end of the runner from a playing surface, creating an angled incline in the runner relative to the playing surface. Projectiles may roll or slide across the runner in the direction of the elevation structure. The projectiles may become airborne after traveling over the elevation structure and land within or near the target.

20 Claims, 12 Drawing Sheets

INTERACTIVE GAME COMPRISING RAMP AND SERIES OF TARGETS

CROSS-REFERENCE TO RELATED APPLICATIONS

The present application claims priority to U.S. Provisional Patent Application No. 63/423,082, filed Nov. 7, 2022, the entire content of which is hereby incorporated by reference herein.

TECHNICAL FIELD

The presently disclosed subject matter relates generally to games of skill, and more particularly to a game where balls are rolled down a ramp into one or more concentric ring targets. The presently disclosed subject matter further includes methods of making and playing the game.

BACKGROUND

Many outdoor games require a large playing area, such as a specially designed park, field, or course. Often, to gain access to some of the playing areas, a fee must be paid. In addition, many prior art outdoor games require players to have a significant amount of expensive gear. Even outdoor games that are portable may require a large playing area. The process for setting up and taking down portable outdoor games is often time consuming and difficult. In addition, many portable outdoor games are bulky, heavy, and do not collapse down to a size that is simple to transport and store when the game is not in use. In addition, conventional games are often not significantly challenging to game players, do not provide sufficient interaction between the game and the player, and/or do not sufficiently entice players to play the game in the first place. For example, prior rolling games (e.g., where a ball is rolled) are typically one-player games that have been in use for many years, thereby becoming boring to players. It would therefore be beneficial to provide a portable outdoor game that overcomes the shortcomings associated with prior art games.

SUMMARY

In some embodiments, the presently disclosed subject matter is directed to a game defined by a pair of supports that cooperate with a runway to form a ramp with a first elevation at a first end and a second elevation at a second end. The elevation between the first ramp end and the second ramp end differs, and each support includes a slot that spans the distance from a first end of the top face to a second end of the top face. The game further includes a runway defined by opposed first and second ends and a pair of side edges, wherein each side edge is positioned within a slot. The game also includes a plurality of rings and a plurality of balls. Each support includes a horizontal bottom face and a curvilinear opposed top face, a front face with a first height and a rear face with a second height that is greater than the first height, and a single side face.

In some embodiments, the game further includes a storage device to house the pair of supports, plurality of rings, and plurality of balls.

In some embodiments, each support has a length of about 5-25 inches and a width of about 1-5 inches.

In some embodiments, the top face of each support is sloped. In some embodiments, the slope of the top face is about 10-85 degrees, 20-70 degrees, 30-60 degrees, or about 45 degrees.

In some embodiments, the first ramp elevation is about 0.1-3 inches.

In some embodiments, the second ramp elevation is about 5-25 inches.

In some embodiments, the slot has a thickness of about 0.1-0.5 inches.

In some embodiments, the rings are permanently attached to each other and/or the top surface of the runway.

In some embodiments, each ring can be independently positioned relative to the other rings.

In some embodiments, each support comprises a plurality of extensions positioned to contact the side edges of the runway.

In some embodiments, the game includes about 2-10 rings.

In some embodiments, one ball differs from at least one other ball in exterior appearance.

In some embodiments, the presently disclosed subject matter is directed to a method of playing a game. The method includes assigning a player or a team to a plurality of balls from the disclosed game. A first player is selected to roll a ball down the ramp, from the first end to the second end, wherein the ball travels the length of the ramp and exits the ramp to travel in attempt to reach a middle portion of at least one ring. The player then rolls the ball. The roll is scored based on the number of points assigned to the ring in which the ball landed. If the ball fails to land within the center portion of a ring, no points are awarded. The steps are repeated with successive players. A winner is determined when a player or team reaches a pre-set number of points.

In some embodiments, each player or team rolls all of their assigned balls before the turn is passed to the next player or team.

In some embodiments, each player or team has their own ramp, rings, or both.

In some embodiments, all players roll simultaneously.

In some embodiments, the winner is determined by the player or team that has the highest number of points after a preset amount of time has elapsed.

In some embodiments, the winner is determined by the player or team that has the most balls in the center portion of the rings at the end of the game.

DETAILED DESCRIPTION

Figure 1:
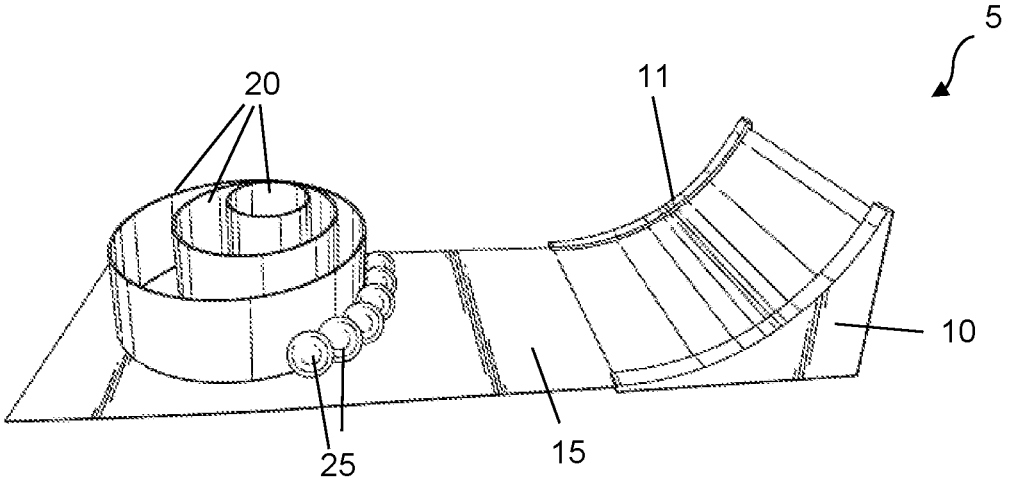
FIG. 1 is a perspective view of a game and the game components in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is generally directed to a portable game that includes the object of rolling one or more balls into target rings. The portable outdoor game includes a ramp that has an elevation structure, providing a challenge to players. As shown in FIG. 1, game 5 includes left and right supports 10, 11 that cooperate with runway 15 to create a ramp with one elevated end. As noted in detail below, in some embodiments, the supports can extend the full length of the runway. The game also includes a series of target rings 20 that are concentrically positioned a set distance from the elevated end of the runway. A series of balls 25 are rolled along the length of the runway with the goal of positioning the ball(s) within the inner portion of rings 20, as described in detail below. Thus, an object of game 5 is to roll ball 10 down the ramp such that the ball becomes airborne after hitting the elevated ramp end and thereby strike the interior of a ring 20 to receive points, credits, or prizes.

As noted above, the game includes left and right supports 10, 11 that cooperate with runway 15 to create a ramp. In some embodiments, the supports can be parallel or about parallel. The term "ramp" refers to a surface that transitions from a first elevation to a second elevation (e.g., a lower elevation to a higher elevation). Embodiments of supports 10, 11 are illustrated in FIGS. 2*a*-2*e*. As shown, each support includes bottom face 30 upon which the support rests and opposed top face 31. At least a portion of the top face can have a curved configuration. In some embodiments, the bottom face can directly contact a support surface, such as the ground, flooring, a driveway, etc. Each support also includes front face 32 with a minimum height and opposed rear face 33 with a maximum height. The top and bottom faces each contact the front and rear faces. Each support further includes a single side face 34 that faces away from the runway.

Figure 2A:
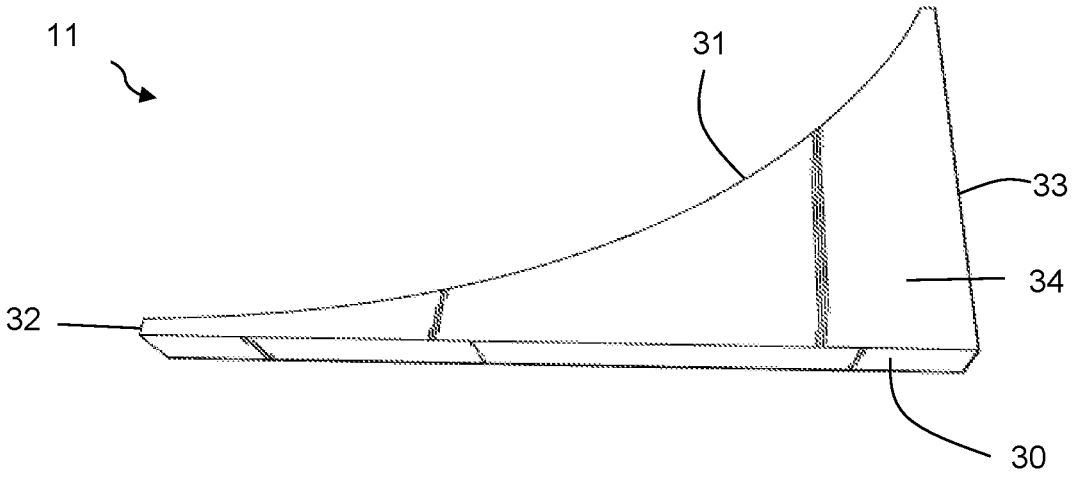
FIG. 2*a* is a side perspective view of a game support in accordance with some embodiments of the presently disclosed subject matter.
Figure 2B:
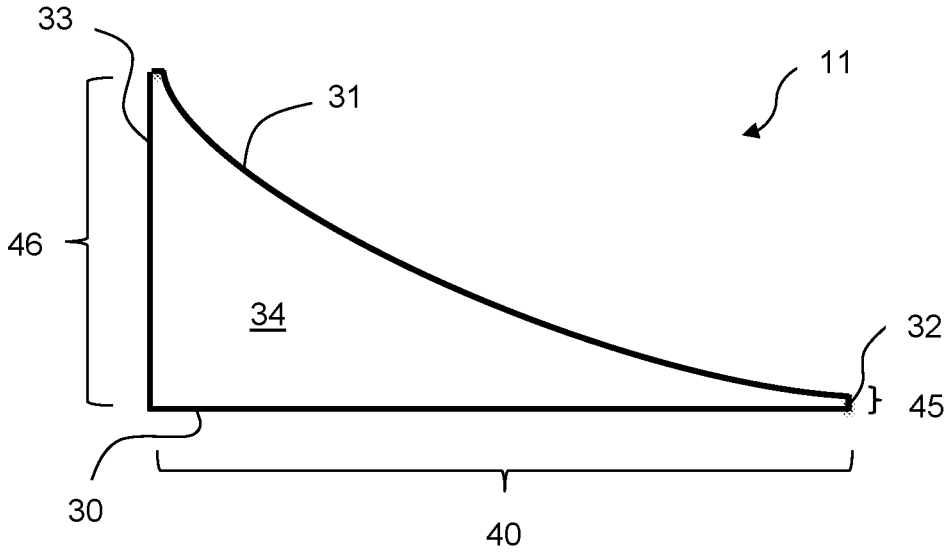
FIG. 2*b* is a side plan view of a game support in accordance with some embodiments of the presently disclosed subject matter.
Figure 2C:
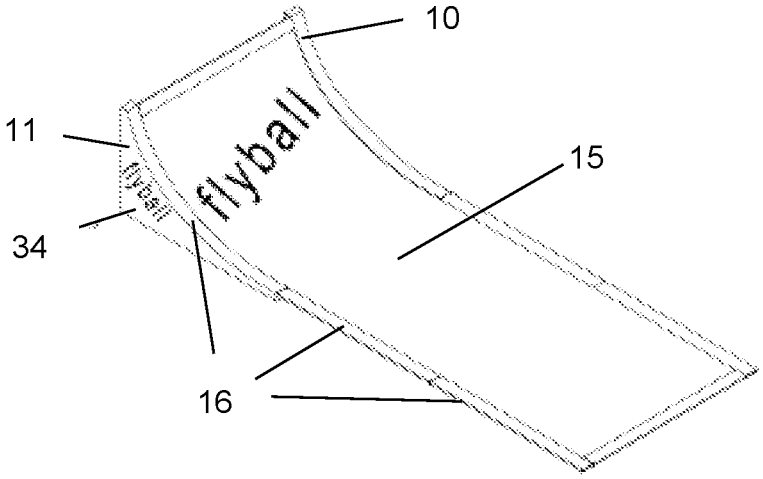
FIG. 2*c* is a perspective view of a game support and ramp in accordance with some embodiments of the presently disclosed subject matter.

In some embodiments, the supports can extend the full length of runway 15, as shown in FIG. 2*c*. To this end, the supports can include one or more extensions 16 that fit together about each side edge of the ramp. Any number of extensions can be used (e.g., 3 or more/less). Alternatively, each support can be configured without extensions, with a length that spans the entire length of the runway. Each extension can have a length of about 5-15 inches or more. The extensions and/or extended length of the supports can assist with maintaining the ramp shape of the game apparatus. Each extension can have a width of about 1-5 inches (e.g., at least/no more than about 1, 2, 3, 4, or 5 inches).

Bottom face 30 can have length 40 of about 5-25 inches (e.g., at least/no more than about 5, 10, 15, 20, or 25 inches). The term "length" refers to the longest horizontal distance from front face 32 to rear face 33. In the embodiment of FIG. 2*c*, the bottom face of each support can have a length of about 1-15 feet or more (e.g., at least/no more than about 1, 2, 3, 4, 5, 6, 7, 8, 9, 10, 11, 12, 13, 14, 15 feet).

Figure 2D:
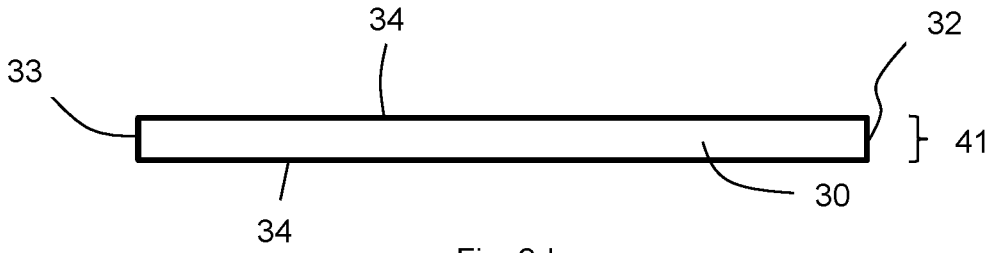
FIG. 2*d* is a bottom plan view of a game support in accordance with some embodiments of the presently disclosed subject matter.

As shown in FIG. 2*d*, the bottom face can have width 41 of about 1-5 inches (e.g., at least/no more than about 1, 2, 3, 4, or 5 inches). It should be appreciated that the length and width of the bottom face is not limited and can be configured outside the given ranges.

Figure 2E:
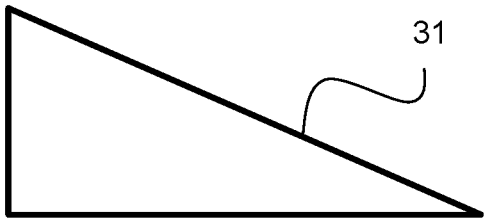
FIG. 2*e* is a side plan view of a support in some embodiments of the presently disclosed subject matter.

A least a portion of top face 31 is sloped, as shown in FIG. 2*b*. The term "sloped" refers to any surface with one end at a higher elevation than the other end. The sloped top face can be angled (e.g., a straight line, as shown in FIG. 2*e*) or can be curved. In some embodiments, the slope can be about 5, 10, 15, 20, 25, 30, 35, 40, 45, 50, 55, 60, 65, 70, 75, 80, or 85 degrees.

Front face 32 joins the first ends of the top and bottom faces. The front face has a minimum height to allow a ball to initially roll onto the ramp when thrown by a player, as noted in detail below. The front face includes minimum height 45 of about 0.1-10 inches (e.g., at least/no more than about 0.1, 0.5, 1, 1.5, 2, 2.5, 3, 3.5, 4, 4.5, 5, 5.5, 6, 6.5, 7, 7.5, 8, 8.5, 9, 9.5, or 10 inches) in some embodiments. The front face minimum height is defined by the vertical distance between the front edges of the top and bottom faces as illustrated in FIG. 2*b*. Similarly, rear edge 33 is defined as the vertical distance between the rear edges of the top and bottom faces. The rear face includes maximum height 46 of about 5-50 inches (e.g., at least/no more than about 5, 10, 15, 20, 25, 30, 35, 40, 45, or 50 inches) in some embodiments. However, heights 45, 46 are not limited and can be greater or less than the given ranges.

Figure 2F:
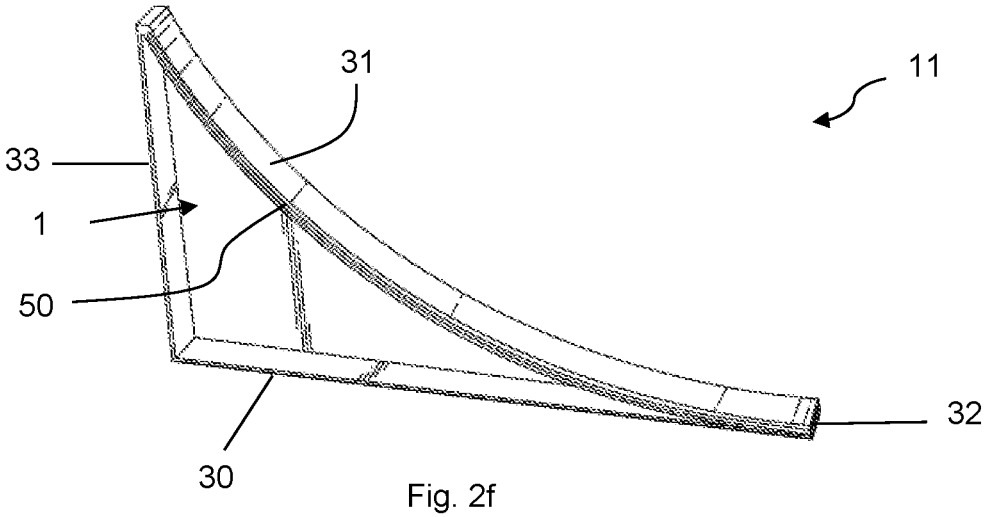
FIG. 2*f* is a perspective view of a game support in accordance with some embodiments of the presently disclosed subject matter.
Figure 2G:
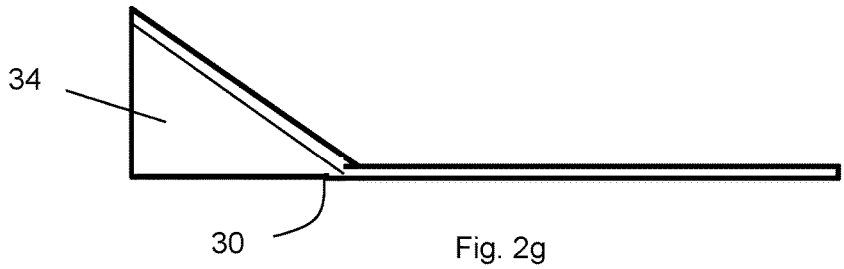
FIG. 2*g* is a side plan view of a game support in accordance with some embodiments of the presently disclosed subject matter.

As set forth above, each support includes side face 34, as illustrated in FIGS. 2*f* and 2*g*. The face 1 opposing side face 34 is open to expose slot 50 that runs along the inner portion top edge 31 (e.g., holding the runway when assembled). The term "slot" broadly refers to any long, narrow aperture or slit. The slot is configured to house the side edges of the runway. The slot can have thickness of about 0.1-0.5 inches in some embodiments, although any thickness can be included. The slot can run the full length of each support to allow for insertion and proper positioning of the runway.

Supports 10, 11 can be constructed from any suitable rigid or semi-rigid material, including (but not limited to) plastic, metal (e.g., copper, stainless steel), wood, foam, rubber, and combinations thereof.

Figure 3A:
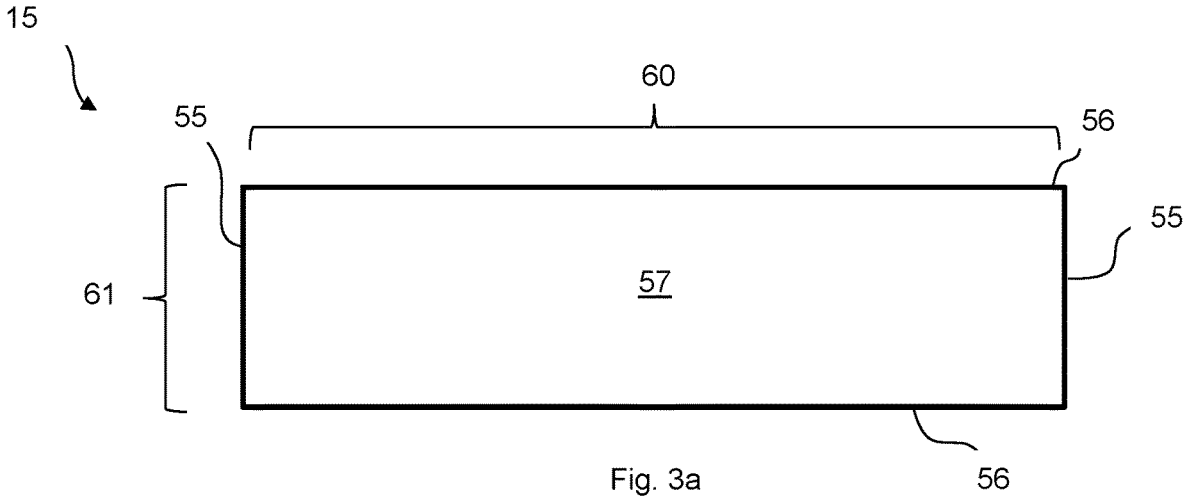
FIG. 3*a* is a top plan view of a game runway in accordance with some embodiments of the presently disclosed subject matter.

The disclosed game further includes runway 15 that provides a surface upon which a ball can be rolled during game play. FIG. 3*a* illustrates one embodiment of runway 15 comprising a pair of opposed front and rear edges 55 and a pair of opposed side edges 56. Each runway also includes top surface 57 and opposed bottom surface 58 upon which the runway can rest. For example, the bottom surface can at least partially contact a support surface, such as a floor, the ground, etc. The top surface of the runway is the surface that directly contacts ball 25, as explained in detail below.

Figure 3B:
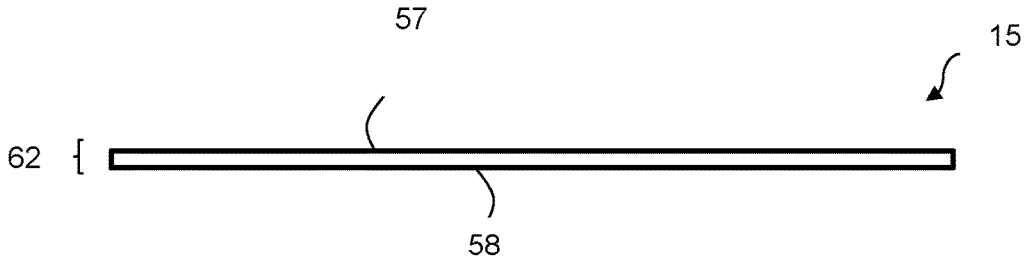
FIG. 3*b* is a side plan view of a game runway in accordance with some embodiments of the presently disclosed subject matter.

Each runway includes length 60 of about 20-100 inches (e.g., at least/no more than about 20, 25, 30, 35, 40, 45, 50, 55, 60, 65, 70, 75, 80, 85, 90, 95, or 100 inches). The runway further includes width 61 of about 10-50 inches (e.g., at least/no more than about 10, 15, 20, 25, 30, 35, 40, 45, or 50 inches). The runway can also include thickness 62 of about 0.1-3 inches (e.g., 0.1, 0.25, 0.5, 0.75, 1, 1.25, 1.5, 1.75, 2, 2.25, 2.5, 2.75, or 3 inches), as illustrated in FIG. 3*b*. It should be appreciated that the length, width, and thickness of the runway is not limited and can be configured outside the given ranges.

Figure 3C:
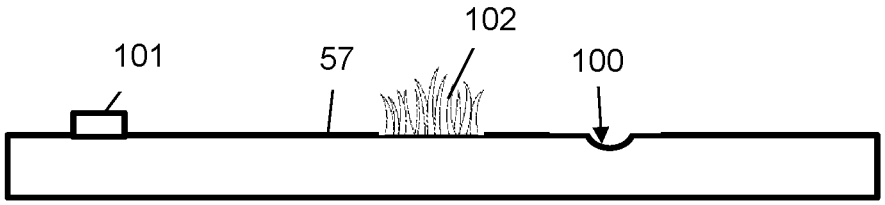
FIG. 3*c* is a side plan view of a game runway in accordance with some embodiments of the presently disclosed subject matter.

The runway can be constructed from any suitable material, such as (but not limited to) plastic, foam, rubber, cardboard, fabric, vinyl, carpet, felt, cloth, and the like. Optionally, the top surface of the runway can include one or more textured areas to add additional challenge to the game. Suitable options include (but are not limited to) one or more divots 100, raised regions 101, rough regions 102, and/or other challenges, as illustrated in FIG. 3*c*. However, these features are optional.

Figure 4A:
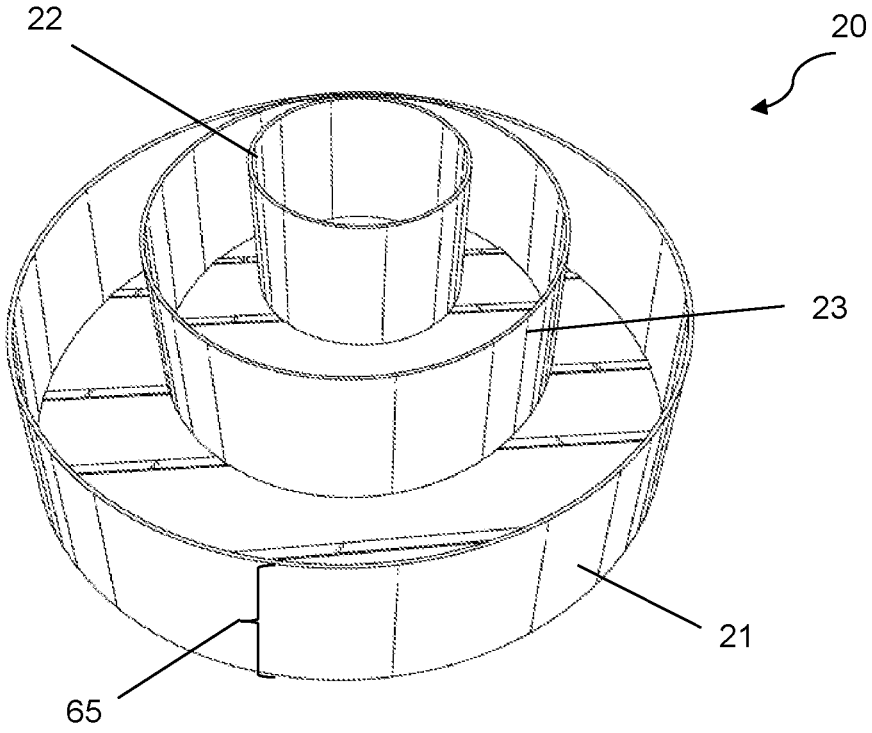
FIG. 4*a* is a perspective view of game rings in accordance with some embodiments of the presently disclosed subject matter.
Figure 4B:
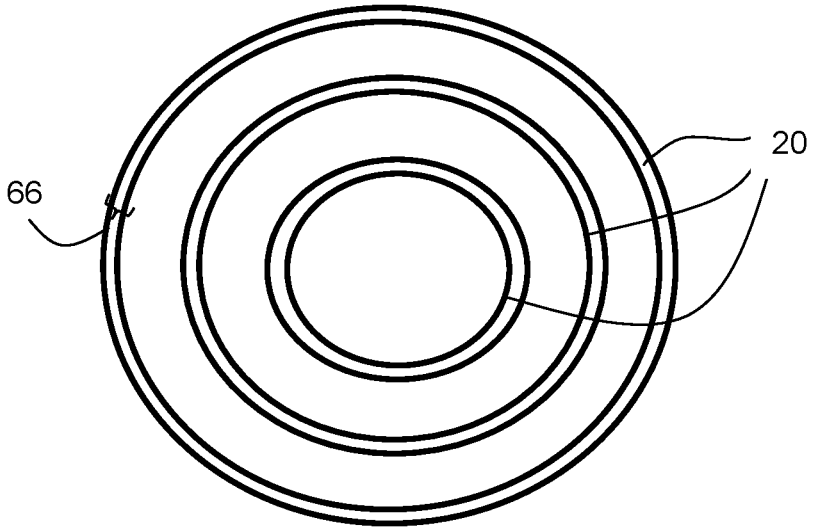
FIGS. 4*b* and 4*c* are top plan views of game rings in accordance with some embodiments of the presently disclosed subject matter.
Figure 4C:
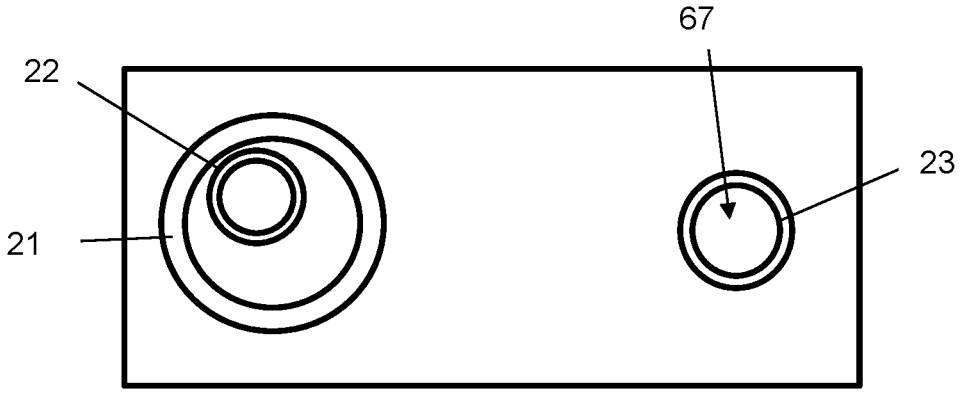

As set forth above, game 5 further includes a plurality of concentric ring targets 20, as illustrated in FIGS. 4*a* and 4*b*. The term "concentric rings" refers to a plurality of rings, each with a diameter that is smaller or larger than at least one other ring. The rings can be configured with an outermost ring 21 with a diameter that is greater than any other ring, and an innermost ring 22 with a diameter that is less than any other ring. Optionally, rings 20 can further include one or more transition rings 23 with a diameter that is less than the outermost ring and greater than the diameter of the innermost ring. The transition rings can fit inside the middle portion of the outermost ring. The rings can be arrayed in various arrangements, such as a concentric configuration, as shown in FIG. 4*b*. However, in some embodiments, at least one ring can be separately positioned, away from at least one other ring, as shown in FIG. 4*c*. Such an arrangement can offer an additional challenge to players, such as (but not limited to) making the separately positioned ring smaller than the other rings, larger than the other rings, and/or worth more/less points compared to the concentric rings.

Figure 4D:
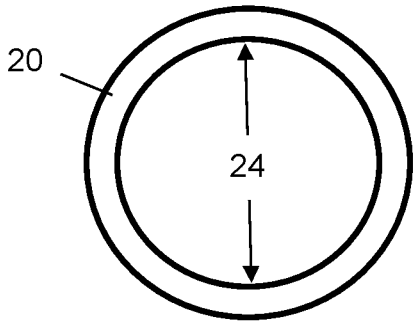
FIGS. 4*d* and 4*e* are top plan views of ring diameters in accordance with some embodiments of the presently disclosed subject matter.
Figure 4E:
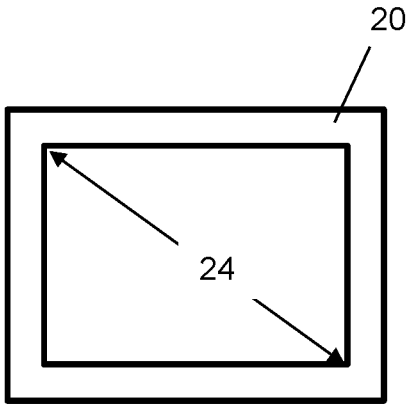

Each ring can have an inner diameter 24 of about 1-25 inches or more (e.g., at least/no more than about 1, 2, 3, 4, 5, 6, 7, 8, 9, 10, 11, 12, 13, 14, 15, 16, 17, 18, 19, or 20 inches). However, the ring diameter is not limited. The term "diameter" refers to the longest straight-line segment that passes through a cross section center of the ring, as shown in FIGS. 4*d* and 4*e*.

The interior region of each ring 20 is associated with a particular point amount or other indication of scoring when a ball lands within a particular ring. In some embodiments, a point value or other indicator can be printed on each ring. Therefore, depending on the location and/or size of a ring, various points may be awarded during game play for successfully landing a ball into the interior region of a ring. Larger rings may have a point designation that is less than the point designation of smaller rings. However, the scoring is not limited.

The rings can be permanently or releasably attached together and/or to the top surface of the runway. For example, each ring 20 can be connected to at least one other ring or the runway using any suitable method, such as adhesive, welding, rivets, tables, tape, VELCRO®, screws, or any other known fastening elements.

Each ring includes height 65 of about 1-10 inches (e.g., at least/no more than about 1, 2, 3, 4, 5, 6, 7, 8, 9, or 10 inches). Each ring further includes thickness 66 of about 0.1-3 inches (e.g., at least/no more than about 0.1, 0.25, 0.5, 0.75, 1, 1.25, 1.5, 1.75, 2, 2.25, 2.5, 2.75, or 3 inches. The height and thickness of each ring can be varied to increase or decrease the difficulty of playing the game. For example, rings with a higher height may be more difficult to throw a ball into compared to lower rings (and therefore awarded a higher point value when a ball is successfully thrown within the ring interior). Similarly, thicker rings have a smaller inner region 67 and thus may be more difficult to throw a ball into.

Figure 4F:
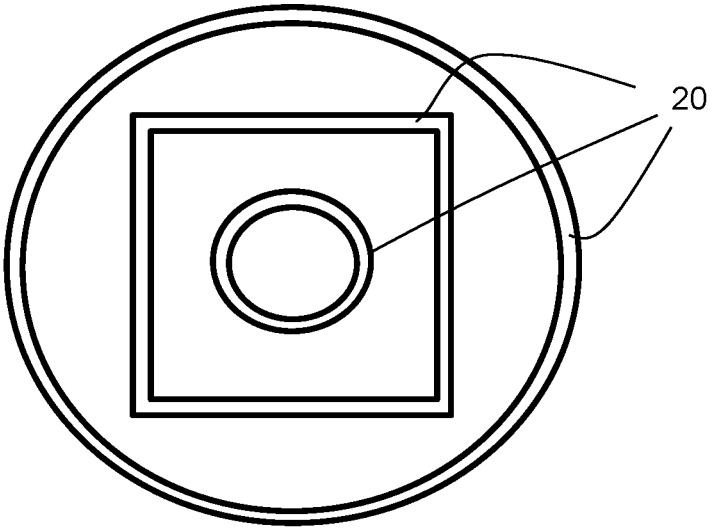
FIG. 4*f* is a top plan view of game rings in accordance with some embodiments of the presently disclosed subject matter.

It should be appreciated that rings 20 can be constructed in any desired shape, such as (but not limited to) circular, oval, square, rectangular, triangular, pentagonal, hexagonal, octagonal, and the like. Any shape can be used. In some embodiments, each ring has the same or about the same shape. In other embodiments, at least one ring differs in shape compared to at least one other ring, as shown in the embodiment of FIG. 4*f*, thereby increasing difficulty and entertainment of the game play.

The disclosed game can include any number of rings 20, such as about 2-10 or more. Thus, any number of rings can be used. In some embodiments, each ring can have a unique diameter, height, and/or thickness compared to the other rings. In other embodiments, more than one ring can have the same or about the same diameter, thickness, and/or height when compared to at least one other ring. In this way, the game can be customized to accommodate different skill levels and/or to create a more difficult/easy game.

Figure 5:
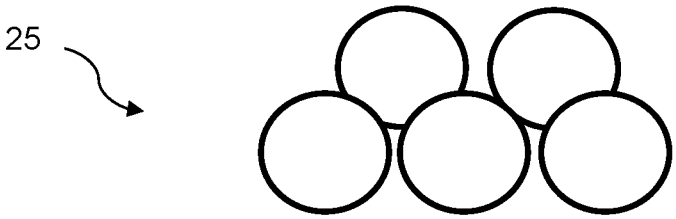
FIG. 5 is a perspective view of a plurality of game balls in accordance with some embodiments of the presently disclosed subject matter.

Game 5 further comprises a plurality of balls 25, as shown in FIG. 5. The term "ball" generally refers to any round object (usually spherical but sometimes ovoid). Balls are common in various games and sports where the game play involves movement of the ball as it is hit, kicked, and/or thrown by players. Game 5 can include any number of balls, such as about 1-10 or more.

In some embodiments, the balls can be denoted in different colors to identify different teams or different players. For example, a first player can be assigned one or more yellow balls, while a second player is assigned one or more green balls. The different colors allow the balls of each player to be easily identified for scoring purposes. Alternatively or in addition, each ball can include a pattern or other indicator that differs from at least one other ball (e.g., stripes, dots, pattern).

Balls 25 can be configured in any suitable size, so long as a ball can fit inside the interior of the innermost ring. Thus, each ball can have a diameter of about 1-5 inches or more (e.g., at least/no more than about 1, 2, 3, 4, or 5 inches). However, it should be appreciated that balls of any size can be used.

Each ball can be constructed from any suitable material. For example, balls 25 can include polyurethane, rubber, felt, wood, plastic, metal, plastic, stone, concrete, polymer resin, vinyl, or combinations thereof. In some embodiments, the interior of each ball is hollow (e.g., filled with air, sand, ball bearings, plastic, rice, etc.). In other embodiments, balls are solid or include an inner core material.

Figure 6:
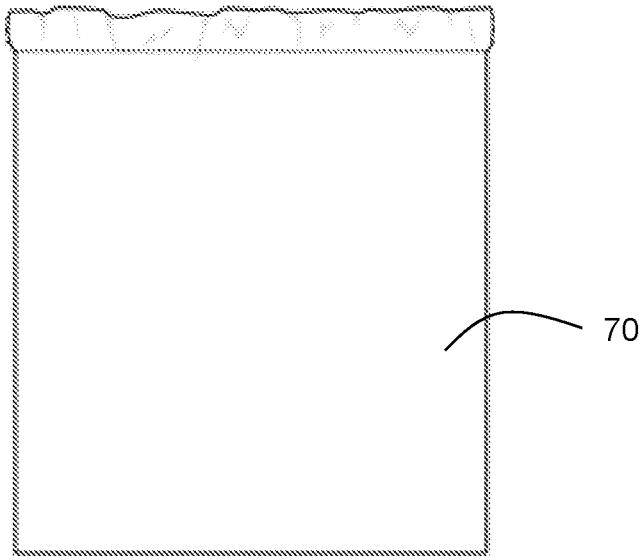
FIG. 6 is a top plan view of a storage device in accordance with some embodiments of the presently disclosed subject matter.

In some embodiments, the game can optionally include storage device 70 as shown in FIG. 6, which can be used to hold the different game components when the game is not in use. The storage device can include any element, such as a bag, box, pouch, or any other container. Advantageously, the storage device can prevent or decrease the chance of losing pieces of the game. The storage device further provides a small footprint for storage when the game is not in use and allows the game to be easily transported from one location to another.

Figure 7A:
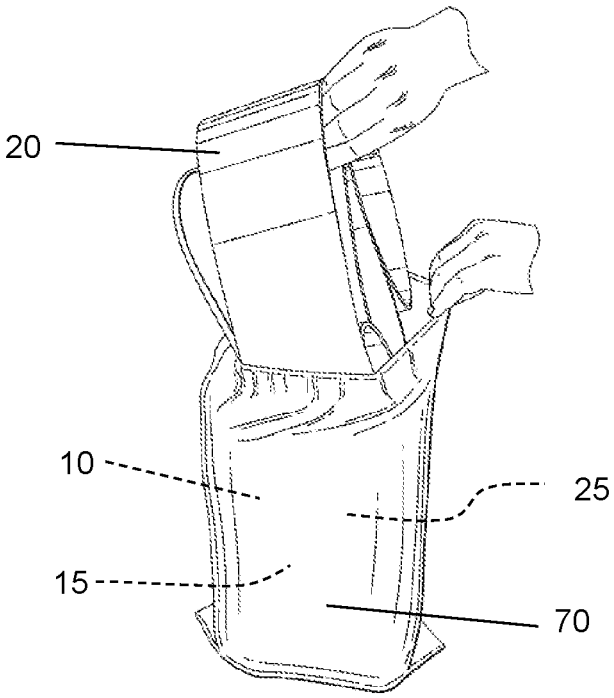
FIGS. 7*a*-7*f* illustrate methods of assembling a game ramp in accordance with some embodiments of the presently disclosed subject matter.
Figure 7B:
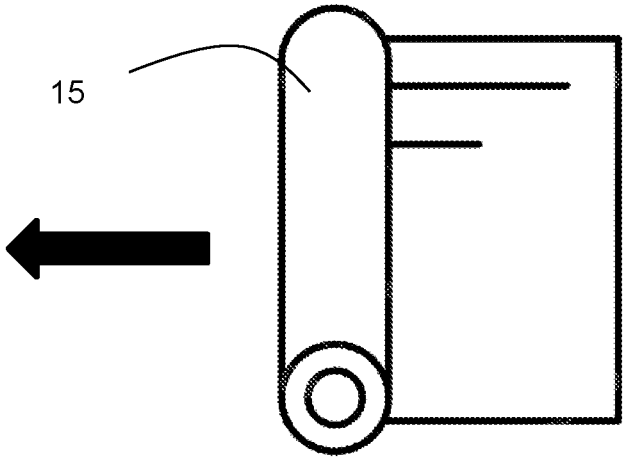
Figure 7C:
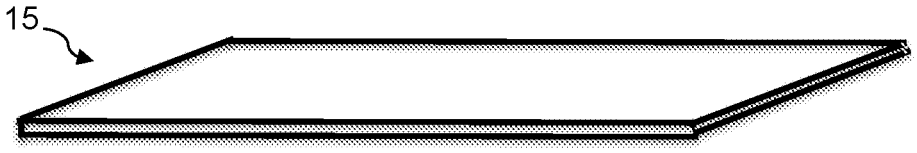

To assemble game 5, the individual game components can first be removed from the storage device (if present), as illustrated in FIG. 7*a*. Runway 15 can then be unrolled or otherwise positioned on a playing surface, such as the floor, a driveway, the ground, on a table, etc., as shown in FIG. 7*b*. In some embodiments, the runway can be stored in a rolled configuration to conserve space when not in use. Thus, a user can easily unroll the runway to a flat orientation as shown in FIG. 7*c*.

Figure 7D:
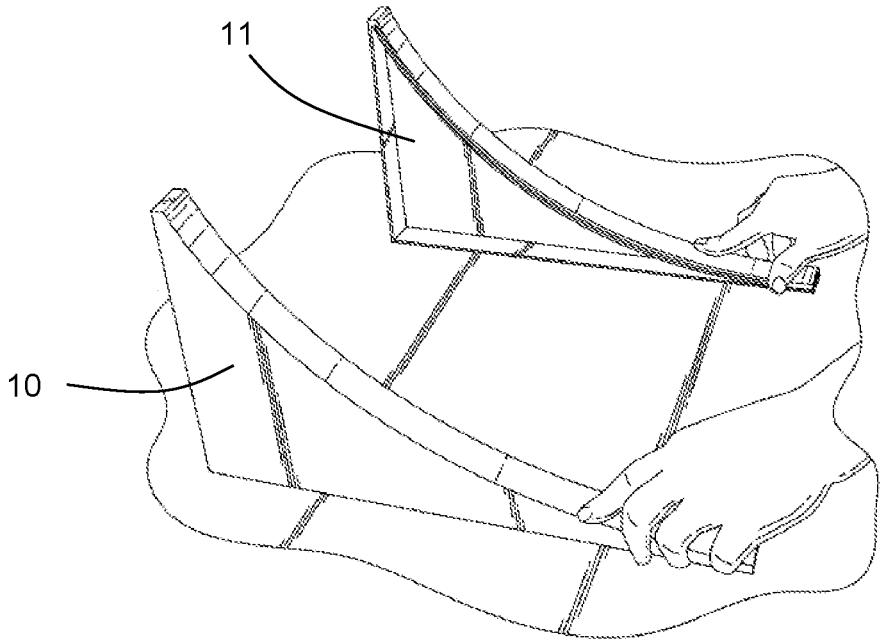
Figure 7E:
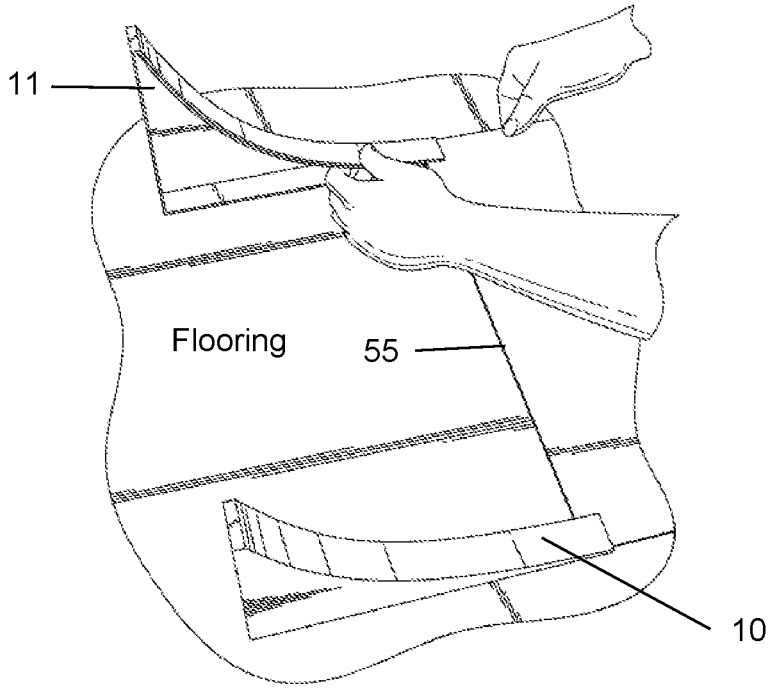

The left and right supports can then be positioned to rest on bottom face 30 and spaced apart so slots 50 are facing each other and the front faces are towards the player, as shown in FIG. 7*d*. Supports 10, 11 should be spaced apart approximately the width of the runway to allow the insertion of the runway into the slots. Side edges 56 of the runway are then slid into slots 50 of the supports, as shown in FIG. 7*e*. In embodiments wherein the supports are extended (as shown in FIG. 2*c*) the runway can be positioned along the entire length of the support and/or slots within extensions 16.

Figure 7F:
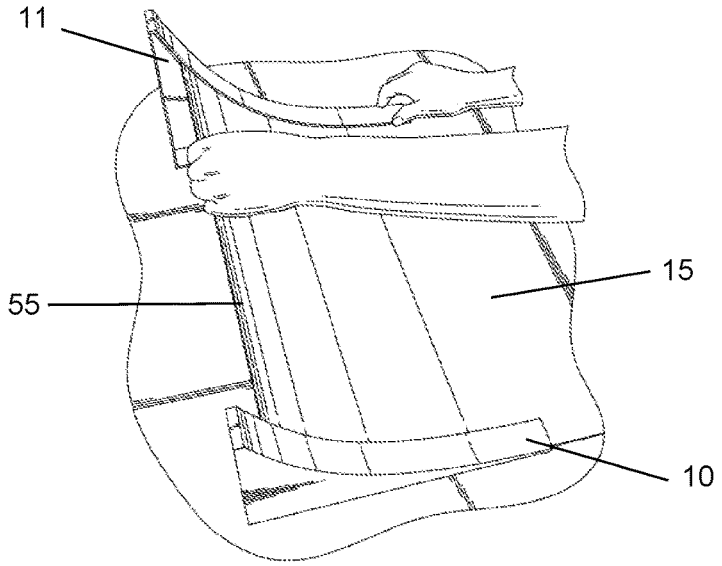

The runway is then advanced so that the front edge of the runway is aligned with the rear face of the left and right supports to create a ramp, as illustrated in FIG. 7*f*. Thus, when assembled, the runway and support create an angled incline from a first end to a second end of the ramp. The slots ensure that the runway remains in proper position and does not attach from the supports.

The target rings are then placed a desired distance from the rear edge (e.g., elevated end) of the ramp. For example, the rings can be positioned about 2-20 feet from the ramp, depending on the degree of difficulty desired and the experience of the players. However, it should be appreciated that the rings can be positioned any distance from the assembled ramp. In some embodiments, a plurality of rings 20 may be used. For example, one set of rings may have a different size and/or shapes and/or be placed at a different location compared to a second set of rings.

Game 5 can be set up and played on any number of different indoor or outdoor surfaces. For example, the game can be set up and played on grass, sand, dirt, or any other natural surface. The bottom face of the runway may include a waterproof or water-resistant treatment or backing to ensure that the top playing surface of the ramp remains dry. When played indoors, the game can be set up and played on any suitable surface, such as carpet, wood flooring, laminate flooring, concrete, and the like.

Figure 8A:
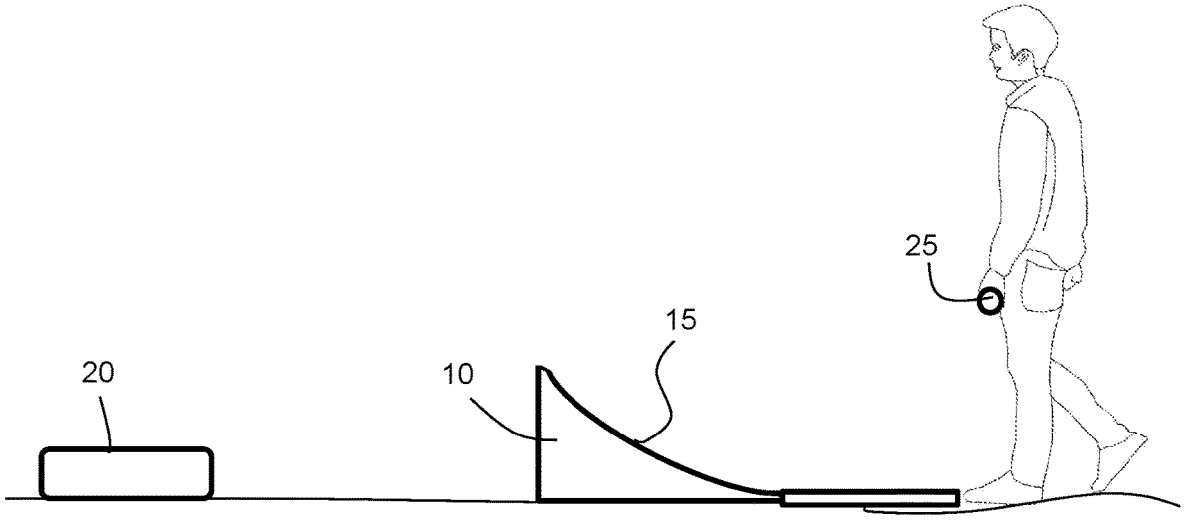
FIGS. 8*a*-8*d* illustrate one method of playing a game in accordance with some embodiments of the presently disclosed subject matter.
Figure 8B:
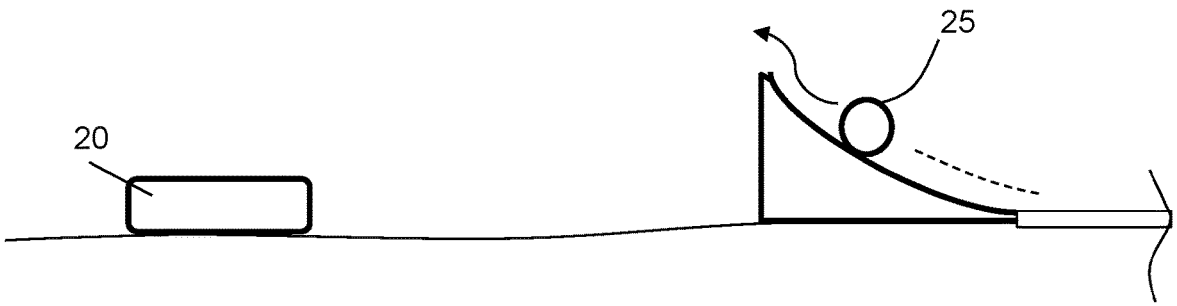
Figure 8C:
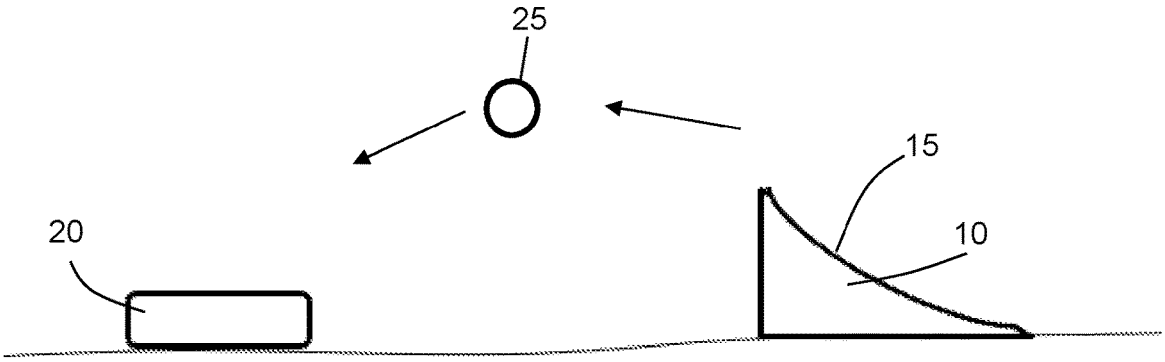
Figure 8D:
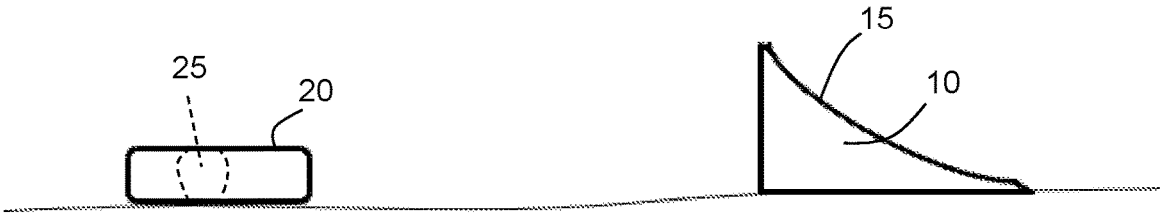

After the game has been assembled, players then select balls 25 (e.g., based on color, pattern, etc.) and game play begins. Playing order can be decided by any suitable method, such as use of dice, a spinner, rotating turns, and the like. Player 1 then stands at the front of the runway, as shown in FIG. 8*a*. Player 1 throws or rolls a ball such that the ball travels along the length of the runway and up the ramp height, as shown in FIG. 8*b*. Thus, the player rolls the ball with sufficient force that it travels along the runway with sufficient force that rolls up and over the elevated ramp end with sufficient distance with the goal to reach at least one ring 20, as shown in FIGS. 8*c* and 8*d*. If appropriately thrown and aimed, ball 25 will follow an arc that will terminate in the center portion 67 of a ring. A point value is then assigned for making the shot.

In some embodiments, the point value for each of the target rings is identical, i.e., the player can choose from one or more rings and—upon ending the ball in any ring interior—will achieve the same number of game points. In other embodiments, some rings can be smaller than others (or placed in a more difficult position) such that the player receives a higher point value for making a more difficult shot. If a player fails to land a ball within the center portion of a ring, no points are awarded or points may be deducted from that player or team's score.

In some embodiments, the game is played with each player taking a turn. Each turn can include one ball thrown per player, or each player throws all of their balls and then the next player throws. After a player's turn is complete, the player's points are calculated, and the next player's turn begins. The game can be measured by the greatest number of points after a set number of turns, e.g., 10 turns. Alternatively, game play can be measured by a set number of points, i.e., the first player to reach 20 points wins the game.

In an alternative embodiment, instead of taking turns, each player throws their balls at the same time as all other players or teams. Two or more players would thus roll their balls down the ramp concurrently with each other. In this embodiment, the players will be "racing" to achieve a certain score, e.g., the first player to 20 points wins, regardless of how many balls are rolled. This provides additional excitement as the players will need to move both quickly and skillfully as there will be an incentive to roll as many balls as possible to reach the goal score first. This also allows additional excitement because (given that all players will be playing simultaneously) players will be in close quarters and can easily distract each other, attempt to divert balls that are in play. In this alternative embodiment, all players can use the same ramp, or each player can be assigned their own ramp.

Once each player has rolled each of their balls, the players may then go retrieve their balls from the rings and surrounding area. Point totals may be added up after each round.

The score for each player can then be calculated. In some embodiments, a player's score is calculated by adding the numbers assigned to each ring associated with a ball thrown by that player. Any point value can be assigned to the rings. One non-limiting example is shown below in Table 1:

| | |
|---|---|
| Large Ring | 1 point |
| Medium Ring | 2 points |
| Small Ring | 3 points |

The lowest score can be subtracted from the highest score, and the player with the highest score receives the calculated score.

Point totals based on a single round may determine the winner. Alternatively, a winner may be determined based on accumulated point totals from two or more rounds. Alternatively, a winner may be determined based on the player that is able to achieve a predetermined number of points first. In addition, a winner may be determined based on the player that has the most points after a set amount of time has expired.

In some embodiments, game 5 may also be played through teams where each team comprises two or more players. Each player on a team may have a turn rolling a ball and scoring points. Point totals from each member of the same team may be combined to determine a winning team as provided above.

Any of a number of variations can be performed to play game 5. For example, the number of rings can be increased or decreased and/or the distance of the rings from the ramp can be increased or decreased to adjust difficulty of the game. In some embodiments, players can sit or kneel to throw or roll their balls down the ramp.

In some embodiments, if a player scores more than the designated winning score, they lose their turn and are given a new score (e.g., an assigned numerical value or a value determined by the players prior to the start of the game).

After the game has been played a desired number of times, the ramp can be disassembled by removing the runway from supports 10, 11 (e.g., removing the runway from slots 50). The balls, supports, runway, and rings can be placed in a storage device and stowed for play at a later date.

In some embodiments, game 5 can include a mobile phone application that allows the player to keep and track scores directly on their phone, to post those scores, and to compare their scores against other players. In one embodiment, the mobile phone application could allow tracking of all players scores and to compare your score against the overall best score of all players for a given configuration. The mobile phone application could be wirelessly connected, via Bluetooth® or Wi-Fi for example, to the electronic scoring mechanism described above.

The presently disclosed game offers many advantages over prior art games. For example, game 5 is more challenging than roll-down games currently available.

The disclosed game is also more interactive compared to prior art roll-down games.

The disclosed game can be played by a wide range of players, from children to the disabled and elderly.

As described above, although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A game defined by:

a pair of supports that cooperate with a runway to form a ramp with a first elevation at a first end and a second elevation at a second end, wherein the elevation between the first ramp end and the second ramp end differs, and wherein each support includes a slot extending from a lower end of the support toward an upper end of the support, the slot being open at the lower end and terminating at the upper end;

a runway defined by opposed first and second ends, the top surface, and a pair of side edges, wherein each side edge is received within a corresponding slot such that the runway is supported and retained within the slots;

a plurality of rings;

a plurality of balls;

wherein each support includes a horizontal bottom face and a curvilinear opposed top face, a front face with a first height and a rear face with a second height that is greater than the first height, and a single side face.

2. The game of claim 1, further comprising a storage device to house the pair of supports, plurality of rings, and plurality of balls.

3. The game of claim 1 wherein each support has a length of about 5-25 inches and a width of about 1-5 inches.

4. The game of claim 1, wherein the top face is sloped.

5. The game of claim 4, wherein the slope of the top face is about 30-70 degrees.

6. The game of claim 1, wherein the first elevation is about 0.1-3 inches.

7. The game of claim 1, wherein the second elevation is about 5-25 inches.

8. The game of claim 1, wherein the slot has a thickness of about 0.1-0.5 inches.

9. The game of claim 1, wherein the rings are permanently attached to each other.

10. The game of claim 1, wherein the rings are permanently attached to each other and the top surface of the runway.

11. The game of claim 1, wherein each ring can be independently positioned relative to the other rings.

12. The game of claim 1, each support comprising a plurality of extensions positioned to contact the side edges of the runway.

13. The game of claim 1, comprising about 2-10 rings.

14. The game of claim 1, wherein 1 ball differs from at least one other ball in exterior appearance.

15. A method of playing a game, the method comprising:

positioning the runway of the game of claim 1 within the slots of the supports to form an inclined ramp having a first end and a second end, wherein the second end is elevated relative to the first end;

positioning at least one ring at a distance from the second end of the ramp;

assigning a player or a team to the plurality of balls;

selecting a first player to roll a ball upward along the top surface of the runway and upward along the ramp from the first end to the second end, wherein the ball travels a length of the ramp and exits the ramp to become airborne and travel towards the at least one ring;

scoring the roll based on the number of points assigned to the at least one ring in which the ball landed;

wherein if the ball fails to land within the center portion of at least one ring, no points are awarded;

repeating the steps with successive players;

wherein the game ends when one player or team reaches a preset number of points.

16. The method of claim 15, wherein each player or team rolls all of their assigned balls along the length of the runway before the turn is passed to the next player or team.

17. The method of claim 15, wherein each player or team has their own ramp, rings, or both, wherein each ramp and corresponding rings are physically separate from those of other players or teams.

18. The method of claim 15, wherein all players roll simultaneously such that each ball is rolled along the ramp toward at least one ring.

19. The method of claim 15, wherein the winner is determined by the player or team that has the highest number of points after a preset amount of time has elapsed, the points being based on the ring in which the ball lands.

20. The method of claim 15, wherein the winner is determined by the player or team that has the most balls in the center portion of the rings at the end of the game, wherein the center portion corresponds to a physical area within each ring in which the ball lands.

* * * * *